US007823585B2

(12) United States Patent
Johnson

(10) Patent No.: US 7,823,585 B2
(45) Date of Patent: Nov. 2, 2010

(54) SNORKEL CLIP

(76) Inventor: Mark Johnson, 1899 E. Siesta Dr., Sandy, UT (US) 84093

( * ) Notice: Subject to any disclaimer, the term of this patent is extended or adjusted under 35 U.S.C. 154(b) by 350 days.

(21) Appl. No.: 11/244,522

(22) Filed: Oct. 6, 2005

(65) Prior Publication Data

US 2006/0112957 A1 Jun. 1, 2006

Related U.S. Application Data

(60) Provisional application No. 60/617,382, filed on Oct. 8, 2004.

(51) Int. Cl.

| | |
|---|---|
| ***B63C 11/16*** | (2006.01) |
| ***B63C 11/02*** | (2006.01) |
| ***A62B 9/04*** | (2006.01) |
| ***A62B 18/08*** | (2006.01) |
| ***F16L 33/02*** | (2006.01) |
| ***A41F 1/00*** | (2006.01) |
| ***A44B 1/04*** | (2006.01) |

(52) U.S. Cl. ..... 128/201.11; 128/201.27; 128/202.27; 128/201.26; 128/912; 24/339; 24/530; 24/531; 24/545; 24/556; 24/564; 24/570; 405/186; 405/187

(58) Field of Classification Search ..... 128/201.11, 128/201.27, 201.26, 912, 202.27; 24/339, 24/530, 545, 531, 555, 564, 570, 556; 405/186, 405/187

See application file for complete search history.

(56) References Cited

U.S. PATENT DOCUMENTS

| | | | |
|---|---|---|---|
| 3,473,561 | A | 10/1969 | Svenson et al. |
| 3,860,042 | A | 1/1975 | Green |
| 3,949,780 | A | 4/1976 | Buckman |
| 3,993,060 | A | 11/1976 | Mitchell |
| 4,032,106 | A | 6/1977 | Schieser et al. |
| 4,066,077 | A | 1/1978 | Shamlian |

(Continued)

FOREIGN PATENT DOCUMENTS

| | | |
|---|---|---|
| GB | 1357249 | 6/1974 |

(Continued)

OTHER PUBLICATIONS

U.S. Appl. No. 10/453,462, filed Jun. 3, 2003, Johnson.

(Continued)

*Primary Examiner*—Patricia M Bianco
*Assistant Examiner*—Nihir Patel
(74) *Attorney, Agent, or Firm*—Workman Nydegger

(57) ABSTRACT

A snorkel clip made up of two substantially rigid elements, which are designed to wrap at least half way around a snorkel tube, overmolded with a substantially flexible element to create a simple, aesthetically pleasing device. The snorkel clip also includes a hinge region created as part of the substantially flexible element. This hinge region allows the snorkel clip to flex or bend so that one of the rigid elements may be disengaged and pulled away from the riser tube of the snorkel, so that a mask strap may be attached to and removed from the snorkel, while the other rigid element remains attached to the riser tube in a generally secure manner. The substantially flexible portion may also include several cut out sections to provide visual and tactile access to portions of the substantially rigid elements for utility and aesthetic design.

32 Claims, 4 Drawing Sheets

U.S. PATENT DOCUMENTS 4,071,024 A 1/1978 Blanc
4,137,935 A 2/1979 Snowdon
4,143,853 A 3/1979 Abramson
4,230,240 A 10/1980 Laauwe
4,278,080 A 7/1981 Schuch
4,344,427 A 8/1982 Marvin
4,523,610 A 6/1985 Orrico
4,562,836 A 1/1986 Perron
4,610,246 A 9/1986 Delphia
4,655,212 A 4/1987 Delphia
4,708,135 A 11/1987 Arkema
4,731,075 A 3/1988 Gallo Mezo et al.
4,782,830 A 11/1988 Forman
4,793,341 A 12/1988 Arasmith
4,805,610 A 2/1989 Hunt
4,832,013 A 5/1989 Hartdom
4,834,084 A 5/1989 Walsh
4,860,739 A 8/1989 Vandepol
4,862,903 A 9/1989 Campbell
4,872,453 A 10/1989 Christianson
4,877,022 A 10/1989 Christianson
4,878,491 A 11/1989 McGilvray, III
4,879,995 A 11/1989 Christianson
4,884,564 A 12/1989 Lamont
4,896,664 A 1/1990 Harayama
4,907,582 A * 3/1990 Meyerrose ..... 128/201.11
4,938,259 A 7/1990 Schmidt
5,020,191 A 6/1991 Uke
5,101,818 A 4/1992 Chace
5,117,817 A 6/1992 Lin
5,129,426 A 7/1992 Boehmer
5,143,059 A 9/1992 Delphia
5,199,422 A 4/1993 Rasocha
5,231,982 A 8/1993 Harrison et al.
5,245,997 A 9/1993 Bartos
5,261,396 A 11/1993 Faulconer et al.
5,265,591 A * 11/1993 Ferguson ..... 128/201.11
5,267,556 A 12/1993 Feng
5,271,432 A 12/1993 Gueret
5,280,785 A 1/1994 Fujima
5,297,545 A 3/1994 Infante
5,327,849 A 7/1994 Miller
5,357,654 A 10/1994 Hsing-Chi
5,381,563 A 1/1995 Isabelle et al.
5,398,673 A 3/1995 Lambert
5,404,872 A 4/1995 Choi
5,487,379 A 1/1996 Koshiishi
5,518,026 A 5/1996 Benjey
5,529,057 A 6/1996 Ferrero et al.
5,606,967 A 3/1997 Wang
5,622,165 A 4/1997 Huang
5,638,811 A 6/1997 David
5,657,746 A 8/1997 Christianson
5,664,558 A 9/1997 Wagoner
5,671,728 A 9/1997 Winefordner et al.
5,697,362 A 12/1997 Albrecht
5,791,524 A 8/1998 Demarest
5,865,169 A 2/1999 Lan et al.
5,868,129 A 2/1999 Christianson
D406,333 S 3/1999 Garraffa
5,893,362 A 4/1999 Evans
5,906,199 A 5/1999 Budzinski
5,924,416 A 7/1999 Miller
5,937,850 A 8/1999 Kawashima
5,947,116 A 9/1999 Gamow
5,960,791 A 10/1999 Winefordner et al.
6,059,157 A 5/2000 Parsons et al.
6,073,626 A 6/2000 Riffe
6,079,410 A 6/2000 Winefordner et al.
6,085,744 A 7/2000 Hermansen et al.
6,119,685 A 9/2000 Kawashima et al.
6,123,320 A 9/2000 Rasanow et al.
6,129,081 A 10/2000 Wu
6,129,116 A 10/2000 Laskowski
6,202,644 B1 3/2001 Takeuchi et al.
6,240,962 B1 6/2001 Tai et al.
6,273,046 B1 8/2001 Pierce
6,276,362 B1 8/2001 Chen-Lieh
6,302,102 B1 10/2001 Giroux et al.
6,318,363 B1 11/2001 Monnich
6,352,075 B1 3/2002 Wang
6,363,929 B1 4/2002 Winefordner et al.
6,371,108 B1 4/2002 Christianson
6,394,417 B1 5/2002 Browne
6,401,711 B1 6/2002 Tibbs
6,435,178 B1 8/2002 Lin
6,478,024 B1 11/2002 White
6,513,520 B2 2/2003 Vinokur et al.
6,655,378 B2 12/2003 Swetish
6,709,604 B2 3/2004 Tai et al.
6,736,136 B2 5/2004 Chen-Lieh
6,827,105 B1 12/2004 Marble et al.
6,883,780 B2 4/2005 Browne et al.
6,908,210 B2 6/2005 Kuo
6,915,801 B2 7/2005 Pokras
7,185,796 B2 * 3/2007 Parsons ..... 224/197
2002/0088460 A1 7/2002 Monnich
2002/0170558 A1 11/2002 Vinokur
2003/0029448 A1 2/2003 Swetish
2003/0037783 A1 2/2003 Feng
2004/0035414 A1 2/2004 Johnson
2005/0034726 A1 2/2005 Pittaway et al.
2006/0102176 A1 5/2006 Junck
2006/0272637 A1 12/2006 Johnson

FOREIGN PATENT DOCUMENTS

GB 2171781 9/1986
GB 2313317 11/1997
JP 10-299922 11/1998
JP 2004-169748 6/2004
TW 573667 1/2004
TW M248730 11/2004
TW M252649 12/2004
WO WO 2006/042063 4/2006
WO WO 2006/127556 11/2006
WO WO 2006/127557 11/2006

OTHER PUBLICATIONS

U.S. Appl. No. 11/249,900, filed Oct. 11, 2005, Johnson.
U.S. Appl. No. 11/437,113, filed May 18, 2006, Johnson.
U.S. Appl. No. 11/923,423, filed Oct. 24, 2007, Johnson.
Fee et al., "Cardiorespiratory responses to increased resistance during exercise," Lung Mechanics, 5032.
Ellingsen, "The influence on the breathing pattern in man of moderate levels of continuous positive and negative airway pressure and of positive end-expiratory pressure during air and $CO_2$ inhalation," ACTA Physiol Scand 1990, 138, 273-282.
Van Der Shans, "Effect of positive expiratory pressure on breathing pattern in healthy subjects," Eur Respir J, 1993, 6, 60-66.
Layon et al., "Continuous positive airway pressure and expiratory positive airway pressure increase functional residuall capacity equivalently," CHEST, 89/4/Apr. 1986, p. 517.
Tobin et al., "Effect of positive end-expiratory pressure on breathing patterns of normal subjects and intubated patients wit respiratory failure," Critical Care Medicine, 1983, p. 859, vol. 11-No. 11, Williams & Wilkins Co.
Savourey et al., "Positive end expiratory pressure (PEEP) slightly modifies ventilatory response during incremental exercise," Aviation, Space and Environmental Medicine, Jan. 2001, p. 21, vol. 72-No. 1.
Muller, "A field study of the ventilatory response to ambient temperature and pressure in sport diving," Br. J. Sports Med., 1995, vol. 29, No. 3, p. 185-190, Butterworth Heinemann.

Office Action dated Sep. 11, 2007 from U.S. Appl. No. 10/453,462, 13 pages.
Office Action dated Feb. 23, 2006 from U.S. Appl. No. 10/453,462, 11 pages.
Office Action dated Jun. 23, 2005 from U.S. Appl. No. 10/453,462, 13 pages.
Office Action dated Mar. 21, 2005 from U.S. Appl. No. 10/453,462, 5 pages.
International Search Report from PCT/US2005/036072 dated Dec. 8, 2006, 2 pages.
International Preliminary Report on Patentability from PCT/US2005/036072 dated Apr. 11, 2007, 6 pages.
Written Opinion from PCT/US2005/036072 dated Sep. 25, 2006, 5 pages.
International Search Report from PCT/US2006/019658 dated Dec. 13, 2006, 2 pages.
International Preliminary Report on Patentability from PCT/US2006/019658 dated Nov. 23, 2007, 4 pages.
Written Opinion from PCT/US2006/019658 dated Oct. 28, 2006, 3 pages.
International Search Report from PCT/US2006/019659 dated Jul. 27, 2007, 2 pages.
International Preliminary Report on Patentability from PCT/US2006/019659 dated Nov. 23, 2007, 5 pages.
Written Opinion from PCT/US2006/019659 dated May 29, 2007, 4 pages.
U.S. Appl. No. 12/034,617, filed Feb. 20, 2008, Johnson.
International Search Report and Written Opinion from PCT/US2007/082520, dated May 7, 2008, 10 pages.
Search Report from Taiwan Application No. 095118125, dated Feb. 18, 2008, 1 page.
International Search Report and Written Opinion from PCT/US2008/054475, dated Aug. 15, 2008, 11 pages.
Office Action from Chinese Patent Application No. 2006800176981, dated Apr. 24, 2009, 9 pages.
Office Action from Australian Patent Application No. 2006251592, dated May 7, 2009, 1 page.
Office Action from Australian Patent Application No. 2006251593, dated May 19, 2009, 2 pages.
Examination Report for Singapore Patent Application No. 200717891-6, dated Jan. 29, 2009, 5 pages.
International Preliminary Report on Patentability from PCT/US0228/054475, dated Aug. 26, 2009, 8 pages.
Examination Report from Canadian Patent Application No. 2,609,479, dated Aug. 27, 2009, 4 pages.
Examination Report from Canadian Patent Application No. 2,609,204 dated Sep. 23, 2009, 2 pages.
Examination Report from New Zealand Patent Application No. 563367 dated Aug. 18, 2009, 2 pages.
Examination Report from New Zealand Patent Application No. 563368 dated Aug. 19, 2009, 2 pages.
European Search Report from EPO Patent Application No. 06770786.9 dated Aug. 5, 2009, 6 pages.
Office Action from U.S. Appl. No. 11/248,900 dated Oct. 16, 2009, 6 pages.

* cited by examiner

SNORKEL CLIP

CROSS-REFERENCE TO RELATED APPLICATIONS

This application claims priority to and the benefit of U.S. Provisional Patent Application Ser. No. 60/617,382, entitled SNORKEL CLIP, which was filed on Oct. 8, 2004, and is hereby incorporated by reference in its entirety.

BACKGROUND OF INVENTION

1. Field of Invention

The present invention relates to snorkels and, in particular, to clips used to attach a snorkel to a mask.

2. Description of Related Art

Skin divers and scuba divers often use masks and snorkels as part of their basic equipment. The snorkel is frequently attached to the strap of the mask using a fastener. Attaching the snorkel to the mask strap may help support the snorkel in a proper position when the diver is using the snorkel as an underwater breathing device. Additionally, when the diver is not breathing through the snorkel, attaching the snorkel to the mask strap may keep the mouth piece of the snorkel in close proximity to the diver's mouth and may prevent the snorkel from being lost.

Conventional snorkels may be designed for use with or incorporate a fastener to attach the snorkel to the mark. These known fasteners, however, often have several shortcomings. For example, many conventional fasteners are often difficult to manipulate and use. This may be very inconvenient for a diver because a conventional snorkel is attached to and removed from a mask on a fairly regular basis. In particular, the diver may attach the snorkel to the mask before each dive and then remove it from the mask after each dive so the snorkel and mask can be cleaned, transported or stored. Because many conventional fasteners have small parts and/or manipulation points, attaching and removing the snorkel from the mask strap using conventional fasteners may be very difficult, especially with cold or gloved fingers. It can also be difficult to adjust the position of the fastener to the snorkel. For example, conventional fasteners are frequently attached to the riser tube of a snorkel and it may be desired to move the fasteners along the riser tube so that the mask and snorkel fit properly and can be used comfortably. This problem may be magnified when the diver is in the water, carrying other equipment, or has cold or gloved fingers.

In addition, many conventional fasteners have various moving, sliding or interlocking parts that can undesirably grab the diver's hair or pinch the diver's skin. Furthermore, the use of hard, inflexible materials in the construction of some of the more bulky known fasteners can cause discomfort if the rigid components are pressed against the diver's face or temple by the mask strap. Further, some known fasteners can accidentally and undesirably detach from the strap of the mask. Accidental detachment of the snorkel may cause discomfort and inconvenience to the diver. Accidental detachment of the snorkel may also cause the snorkel to be lost if the diver is not using the snorkel, such as when a scuba diver is using his or her regulator.

BRIEF SUMMARY OF INVENTION

One aspect is a snorkel clip that may be used to easily attach and detach a snorkel to and from the strap of a diving mask.

Another aspect is a snorkel clip that may be quickly and easily adjusted. For example, the snorkel clip may be quickly and easily adjusted along the riser tube of a snorkel.

Still another aspect is a snorkel clip that may securely hold a snorkel in place during use. For instance, the snorkel clip may keep the snorkel from moving out of a preferred position or becoming lost.

Yet another aspect is a snorkel clip that may be comfortable for the diver to use. For example, the snorkel clip may be sized and configured so that it will not pull on the diver's hair or be uncomfortable against the diver's face or temple.

Still yet another aspect is a snorkel clip that is aesthetically pleasing. For instance, the snorkel clip may have a sleek and pleasant design or a color scheme that is intended to match or compliment the design or color scheme of a mask, snorkel or other diving equipment.

A further aspect is a snorkel clip that may be efficiently produced. Advantageously, modern manufacturing techniques, such as overmolding, may be used to manufacture the snorkel clip.

Another aspect is a snorkel clip that may be constructed using at least one substantially rigid component and at least one substantially flexible component. For example, the snorkel clip may be manufactured by overmolding a substantially flexible rubber component onto two substantially rigid plastic components. Significantly, this may be used to create a snorkel clip that is simple and aesthetically pleasing in design, easy to manipulate and comfortable to use.

Still another aspect is a snorkel clip that may include two substantially rigid plastic components. Advantageously, the two substantially rigid plastic components may act as a substantially rigid framework for the clip and they may allow the clip to be attached to a riser tube of a snorkel in a secure manner. In greater detail, the two substantially rigid plastic components may include two attachment arms and the two attachment arms may cause each plastic component to wrap at least half way around the riser tube of the snorkel in order to attach the clip to the snorkel in a secure manner. Furthermore, at least one of the substantially rigid components can be attached to the riser tube of the snorkel in a snap fit manner, which may allow it to be easily connected to or disengaged from the riser tube of the snorkel. These substantially rigid components may also provide the snorkel clip with an internal rigidity that makes it possible to push the clip up or down the riser tube of the snorkel without causing the clip to deform significantly.

Yet another aspect is a snorkel clip that includes a substantially flexible component. Preferably, the substantially flexible component is made of rubber and is overmolded onto one or more substantially rigid plastic components. Advantageously, the substantially flexible component may act as a hinge and/or a pad. For example, the substantially flexible component may allow the snorkel clip to bend so that a substantially rigid plastic component of the snorkel clip can be disengaged and pulled away from the riser tube of the snorkel while another substantially rigid plastic component of the snorkel tube remains attached to the riser tube. This may provide a large, swing-open access to an opening between the snorkel clip and the riser tube of the snorkel into which a mask strap can be placed. Once the mask strap is in place, the substantially flexible portion of the snorkel clip may allow the disengaged, substantially rigid component to be repositioned or reconnected to the riser tube of the snorkel in order to secure mask strap between the snorkel clip and the riser tube. The substantially flexible portion may also provide padding at the parts of the snorkel clip that are likely to contact the riser tube of the snorkel, the face or temple of the user and/or the fingers of the user. In addition, this padding may prevent the snorkel clip from slipping up or down along the riser tube of the snorkel, provide a soft cushion against the user's head for comfort and/or provide for easier manipulation and adjustment of the clip.

A further aspect is a snorkel clip that may be manufactured by overmolding a rubberized component onto two plastic components to create a relatively slim design, which may make the clip more comfortable to use and may allow the clip to be used in a wide variety of situations and environments. Additionally, the snorkel clip may be quickly and easily manufactured because it may include only a rubberized component and two plastic components. Advantageously, this may create a snorkel clip that is easy and intuitive to use and to manipulate. Furthermore, because the snorkel clip preferably does not include multiple interlocking pieces, it may not trap and pull the user's hair or skin while in use.

A still further aspect is a snorkel clip that may be manufactured by overmolding a rubberized component of one color onto one or more plastic components of another color to create an aesthetically pleasing, two-tone snorkel clip. These colors can be selected to match or complement the other diving gear the user has or is likely to have. Furthermore, the rubberized component can be designed to include certain holes, voids, or cut outs through which a plastic component of a different color can be seen or touched. By this means, thumb or finger tabs molded into the plastic components can extend through the rubberized component in order to provide better grip and easier manipulation. Additionally, a manufacturer may, in this manner, easily and permanently adorn the snorkel clip with a decorative design or logo.

Advantageously, the snorkel clip may have a variety of suitable designs and configurations depending, for example, upon the intended use of the snorkel clip. In addition, the snorkel clip may have a sleek and simple in design, which may allow for comfortable use and ease of manufacture. Furthermore, the snorkel clip, while effective in securing a snorkel to the strap of a mask, may be easy to manipulate and may allow for relatively easy attachment, detachment and adjustment.

These and other objects and features of the present invention will become more fully apparent from the following description and appended claims, or may be learned by the practice of the invention as set forth hereinafter.

BRIEF DESCRIPTION OF DRAWINGS

The appended drawings contain figures of preferred embodiments of the present invention to further clarify the above and other aspects, advantages and features of the present invention. It will be appreciated that these drawings depict only preferred embodiments of the present invention and are not to be considered limiting of its scope. The invention will be described and explained with additional specificity and detail through the use of the accompanying drawings in which.

DETAILED DESCRIPTION OF PREFERRED EMBODIMENTS

It will be readily understood that the components of the present invention, as generally described and illustrated in the Figures herein, could be arranged and designed in a wide variety of different configurations. Thus, the following more detailed description of the snorkel clip or clips representing presently preferred embodiments of the present invention is not intended to limit the scope of the invention, as claimed, but it is merely representative of presently preferred embodiments of the invention.

Figure 1A:
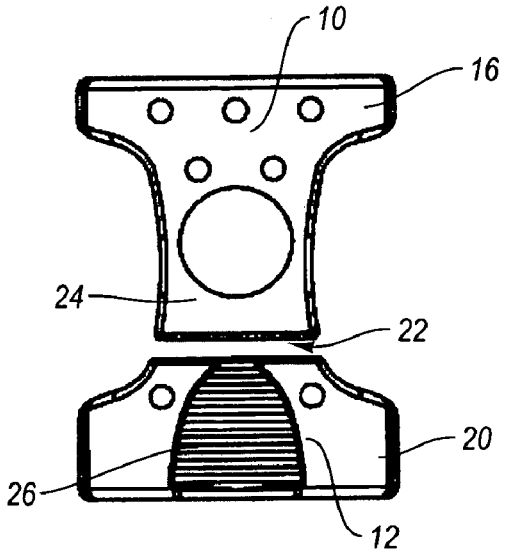
FIG. 1A is a front view of a portion of an exemplary embodiment of a snorkel clip, illustrating two substantially rigid components.
Figure 1B:
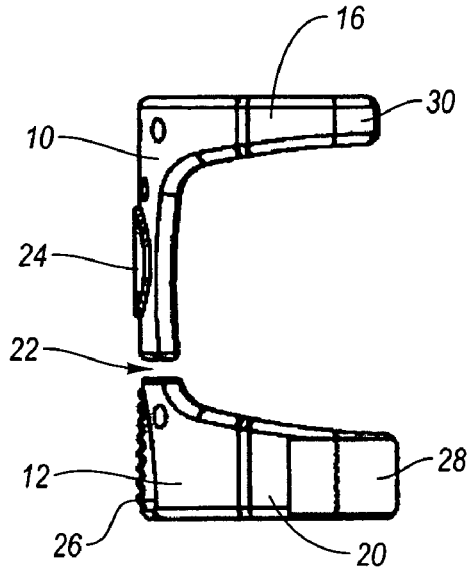
FIG. 1B is a side view of the two substantially rigid components shown in FIG. 1A.
Figure 1C:
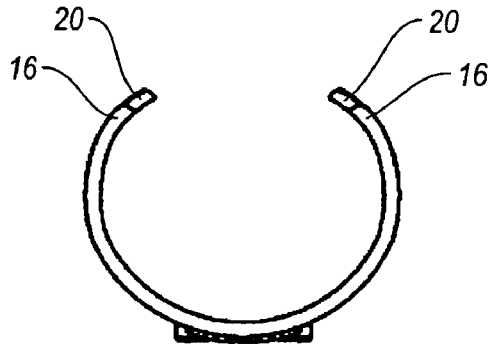
FIG. 1C is a top view of the two substantially rigid components shown in FIG. 1A.

As shown in the accompanying figures, the snorkel clip may include a substantially rigid core or framework with an upper substantially rigid portion 10 and a lower substantially rigid portion 12. The upper substantially rigid portion 10 and the lower substantially rigid portion 12, as best seen in FIGS. 1A through 1C, are preferably constructed from a relatively strong and rigid, such as plastic. Advantageously, the rigid portions 10, 12 may provide the snorkel clip with an internal structural support.

Figure 2A:
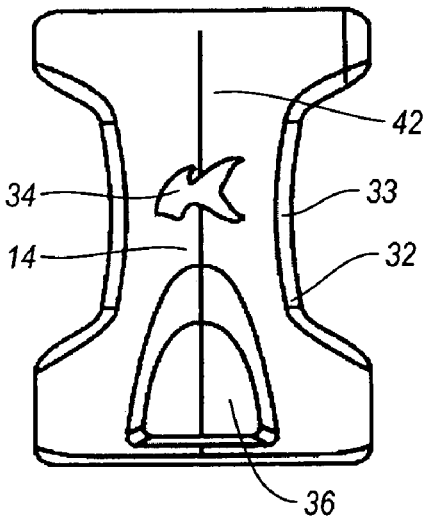
FIG. 2A is a front view of another portion of an exemplary embodiment of a snorkel clip, illustrating a substantially flexible component.
Figure 2B:
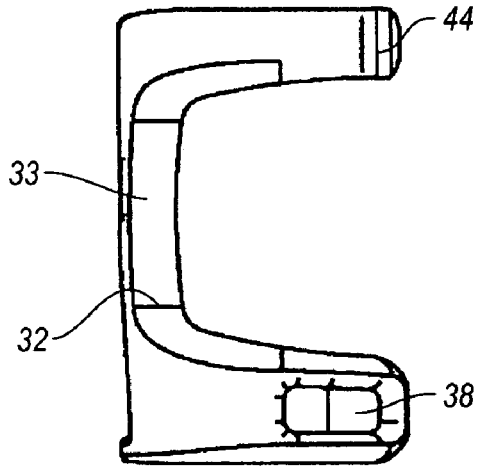
FIG. 2B is a side view of the substantially flexible component shown in FIG. 2A.
Figure 2C:
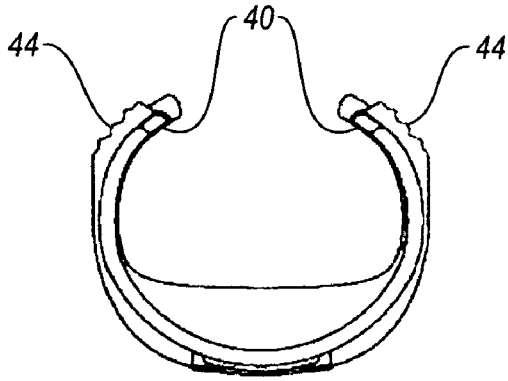
FIG. 2C is top view of the substantially flexible component shown in FIG. 2A.
Figure 3A:
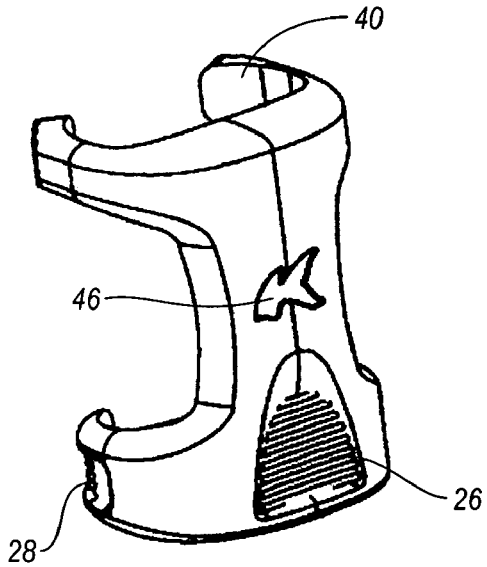
FIG. 3A is a perspective view of an exemplary embodiment of the snorkel clip, illustrating a substantially flexible component overmolded onto two substantially rigid components.
Figure 3D:
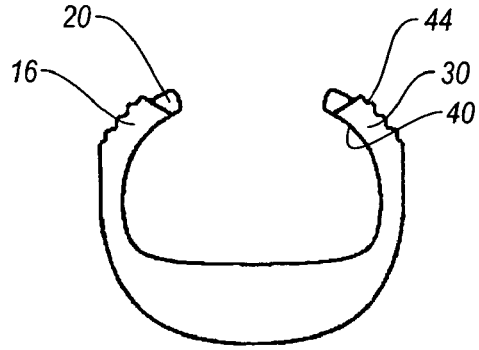
FIG. 3D is a top view of the snorkel clip shown in FIG. 3A.
Figure 3B:
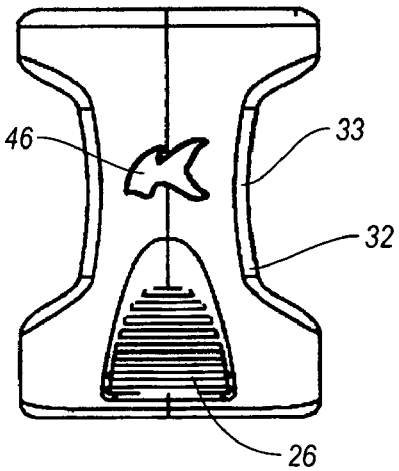
FIG. 3B is a front view of the snorkel clip shown in FIG. 3A.
Figure 3C:
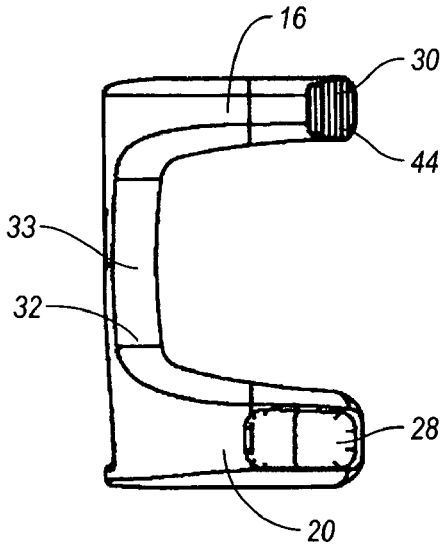
FIG. 3C is a side view of the snorkel clip shown in FIG. 3A.

The snorkel clip may also include a substantially flexible portion 14, as best shown in FIGS. 2A through 2C. The substantially flexible portion 14 may be constructed from a generally soft and flexible material, such as rubber. Significantly, the substantially flexible portion 14 may provide flexibility and a grip to the snorkel clip. As shown in FIGS. 3A through 3D, when the substantially flexible portion has been connected to the upper substantially rigid portion and the lower substantially rigid portion, a complete snorkel clip may be formed. As discussed in more detail below, the substantially flexible portion 14 is preferably connected to the upper substantially rigid portion 10 and the lower substantially rigid portion 12 by overmolding, but it will be appreciated that the substantially flexible portion may be connected to the rigid portions in any suitable manner or by any desired process.

Figure 4A:
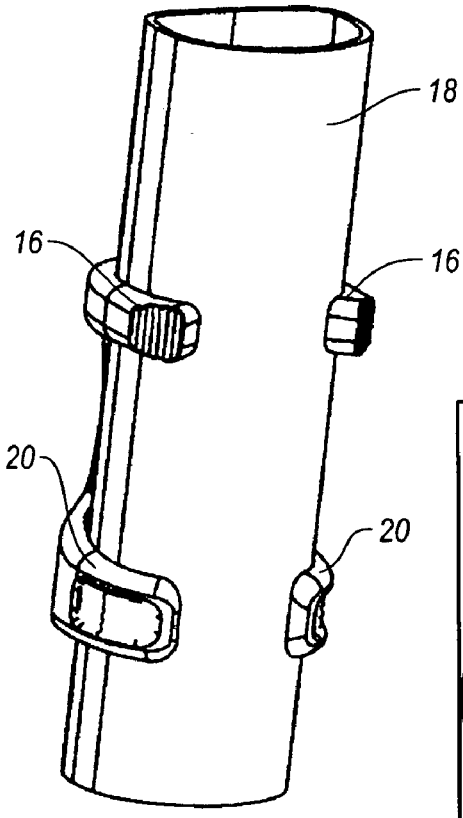
FIG. 4A is a rear perspective view of an exemplary embodiment of a snorkel clip, illustrating the snorkel clip attached to the riser tube of a snorkel.
Figure 4B:
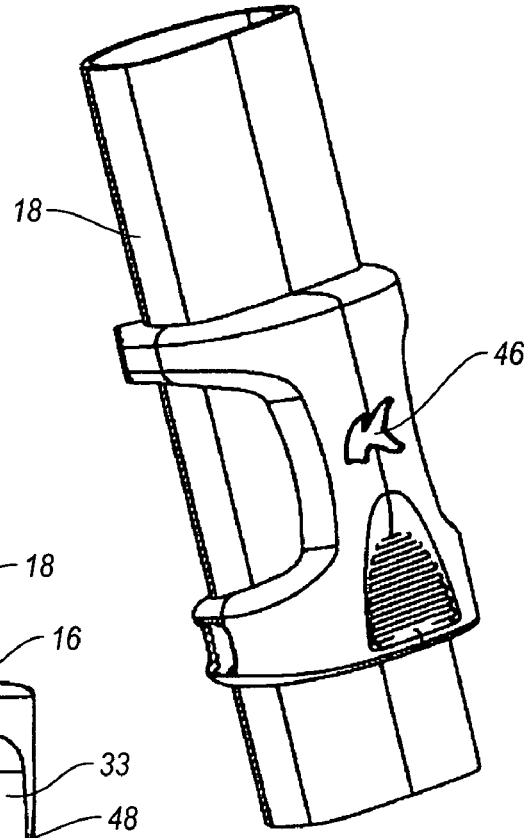
FIG. 4B is a front perspective view of the snorkel clip shown in FIG. 4A.
Figure 4C:
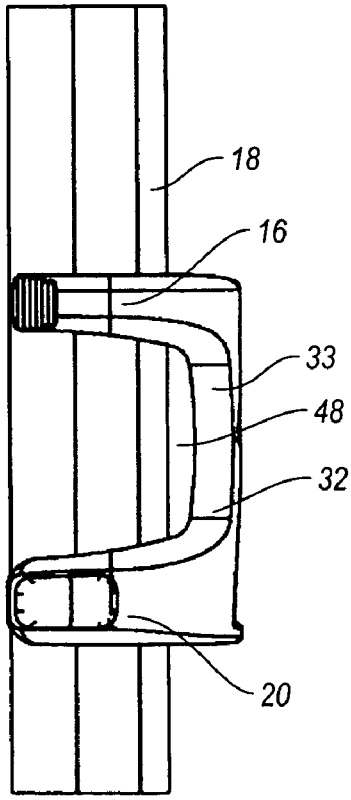
FIG. 4C is a side view of the snorkel clip shown in FIG. 4A.

Referring now to FIGS. 1A through 1C, in one presently preferred embodiment of the snorkel clip, the upper substantially rigid portion 10 may include two upper attachment arms 16 which are sized and configured to wrap at least half way around the riser tube 18 of a snorkel. The riser tube 18 of a snorkel is illustrated in FIGS. 4A through 4C. While the upper attachment arms 16 are wrapped at least half way around the riser tube 18 of a snorkel, the upper substantially rigid portion 10 remains generally connected to the riser tube 18. Because the upper attachment arms 16 are part of the upper substantially rigid portion 10, they are preferably constructed of a generally hard plastic and are substantially rigid.

In one exemplary embodiment of the snorkel clip, if a reasonable amount of force is applied to the upper attachment arms 16, the upper attachment arms 16 may deform slightly in an outward direction. This may allow the user of the snorkel clip to move the upper substantially rigid portion 10 away from the riser tube 18 of the snorkel without sliding the entire snorkel clip off of the riser tube 18. When the user of the snorkel clip pulls the upper substantially rigid portion 10 away from the riser tube 18, the upper attachment arms 16 may deform in an outward direction in order to create enough space between them for the riser tube 18 to pass. Once the upper substantially rigid portion 10 is moved away from the riser tube 18, the upper attachment arms 16 preferably return back to their normally biased portion with respect to the upper substantially rigid portion 10. This slight deformation of the upper attachment arms 16 may also allow the user of the snorkel clip to press the upper substantially rigid portion 10 into engagement with the riser tube 18 of the snorkel in a snap fit manner. When the user of the snorkel clip pushes the upper substantially rigid portion 10 into contact with the riser tube 18, the upper attachment arms 16 may again deform in an outward direction in order to create enough space between them for the riser tube 18 to pass. Once the riser tube 18 passes through this space between the upper attachment arms 16, the upper attachment arms 16 preferably return back to their normally biased portion with respect to the upper substantially rigid portion 10 and wrap at least half way around the riser tube 18 thereby holding the upper substantially rigid portion 10 generally against the riser tube 18.

As shown in FIGS. 1A through 1C, the lower substantially rigid portion 12 may also include two lower attachment arms 20. The lower attachment arms 20 are preferably sized and configured to wrap at least half way around the riser tube 18 of the snorkel. While the lower attachment arms 20 are wrapped at least half way around the riser tube 18 of a snorkel, the lower substantially rigid portion 12 may remain at least partially connected to the riser tube 18. Because the lower attachment arms 20 may be part of the lower substantially rigid portion 12, the arms are preferably constructed from a strong and rigid material such as plastic.

The lower attachment arms 20 preferably resist outward deformation more than the upper attachment arms 16. Therefore, where the upper substantially rigid portion 10 may be fairly easily attached to and disengaged from the riser tube 18 of a snorkel, the lower substantially rigid portion 12 preferably remains at least partially attached to the riser tube 18 as long as the lower attachment arms 20 are wrapped at least partially around the riser tube 18.

A hinge space or region 22 may be disposed at least partially between the upper substantially rigid portion 10 and the lower substantially rigid portion 12. The hinge region 22 may provide a break or pivot point between the upper substantially rigid portion 10 and the lower substantially rigid portion 12. Advantageously, the hinge region 22 may allow the completed snorkel clip to bend or flex at this area. Because the hinge region 22 is preferably located between the upper substantially rigid portion 10 and the lower substantially rigid portion 12, the upper substantially rigid portion and the lower substantially rigid portion may move independently of one another. This movement, however, may be restricted by the rubber overmolding 14. For example, the snorkel clip may bend at the hinge region 22 to allow the upper substantially rigid portion 10 to extend away from the riser tube 18 of the snorkel while the lower substantially rigid portion 12 remains generally connected to the riser tube 18, but the upper substantially rigid portion 10 and the lower substantially rigid portion 12 will not completely detach one from another. It will be appreciated, however, that the upper substantially rigid portion 10 and the lower substantially rigid portion 12 do not have to be separate components and the hinge region 22 is not required. It will also be appreciated that the hinge region 22 could be constructed with other suitable structures and materials. For example, the hinge region 22 could include a relatively narrow portion of a single substantially rigid core or framework along which the single substantially rigid core or framework can bend or flex.

As shown in FIGS. 1A through 1C, the snorkel clip may also include a strap retaining bar 24. The strap retaining bar 24 is preferably at least partially disposed between the upper attachment arms 16 and the lower attachment arms 20 of the snorkel clip. The strap retaining bar 24 may also be part of the upper substantially rigid portion 10. In addition, the strap retaining bar 24 may be constructed of a relatively strong and rigid material, such as plastic. Advantageously, the rigidity provided by the strap retaining bar 24 may allow the snorkel clip to be easily adjusted up and down the riser tube 18 of the snorkel. For example, if the user of the snorkel clip pushes up on the lower substantially rigid portion 12, the strap retaining bar 24 may provide enough structure so that the entire snorkel clip slides up the riser tube 18 of the snorkel without suffering any significant deformation.

The lower substantially rigid portion 12 of the snorkel may also include a thumb slider tab 26, which is preferably located on the base of the lower substantially rigid portion 12, and one or more finger slider tabs 28, which are preferably located on the lower attachment arms 20. The thumb slider tab 26 and the finger slider tables 28 may allow the user of the snorkel clip to push up or pull down on the lower substantially rigid portion 12 to adjust the position of the snorkel clip along the riser tube 18 of the snorkel. The upper substantially rigid portion 10 may also include finger opening tabs 30, which are preferably located on the upper attachment arms 16, that are sized and configured to allow the user to pull on to move the upper substantially rigid portion 10 away from the riser tube 18 of the snorkel. The thumb slider tab 26, the finger slider tabs 28 and/or the finger opening tabs 30 may also include texturing, such as ridges, to provide the user with sufficient grip to manipulate and adjust the snorkel clip.

Referring now to FIGS. 2A through 2C, the snorkel clip may include a substantially flexible portion 14. The substantially flexible portion 14 is preferably a rubber overmolding that is created by overmolding generally flexible rubber onto the upper substantially rigid portion 10 and the lower substantially rigid portion 12. The rubber overmolding 14 may include a rubber hinge 32 that is located proximate the hinge region 22. Because the rubber hinge 32 is preferably part of the substantially flexible portion 14, it may be flexible. Furthermore, because the rubber hinge 32 is preferably located proximate the hinge region 22, the snorkel clip may bend at the rubber hinge 32 to allow the upper substantially rigid portion 10 to detach from and extend away from the riser tube 18 of the snorkel while the lower substantially rigid portion 12 remains generally connected to the riser tube 18.

The rubber overmolding 14 may include a strap retaining portion 33. In particular, the strap retaining portion 33 may be part of the rubber overmolding 14 and it may be molded around the strap retaining bar 24 of the upper substantially rigid portion 10. When the snorkel clip is in use, a mask strap may be held in place between the strap retaining portion 33 and the riser tube 18 of the snorkel. That is, the strap of the mask may be held in place between the strap retaining portion 33 and the riser tube 18 of the snorkel when the snorkel clip is attached to a snorkel. The strap retaining portion 33 may have a relatively slim design. In addition, the strap retaining portion 33 may be sized and configured so that it does not wrap itself at least half way round the riser tube 18 of a snorkel. That is, the strap retaining portion 33 may not wrap at least half way around the riser tube 18 of a snorkel. Therefore, when the snorkel clip is in use, the mask strap may continue around the diver's head generally unimpeded, which may minimize any discomfort or distress to the user.

The rubber overmolding 14 preferably covers at least a portion of the upper substantially rigid portion 10 and the lower substantially rigid portion 12 of the snorkel clip. The rubber overmolding 14 may also substantially or completely cover the upper substantially rigid portion 10 and the lower substantially rigid portion 12 of the snorkel clip, if desired. The rubber overmolding 14 may also include several cut out portions through which parts of the upper substantially rigid portion 10 or the lower substantially rigid portion 12 can be seen or touched. For instance, the rubber overmolding 14 may include a decorative cut out portion 34 through which a part of the upper substantially rigid portion 10 or part of the lower substantially rigid portion 12 may be seen. The decorative cut out portion 34 may be in the shape of a decorative design to increase the aesthetic appeal of the snorkel clip. The decorative cut out portion 34 may also be in the shape of a company logo or trademark in order to provide a marking or identifying function in addition to increasing the aesthetic appeal of the snorkel clip.

The rubber overmolding 14 may also include a thumb slider cut out portion 36 through which a user of the snorkel clip can see and touch the thumb slider tab 26 of the lower substantially rigid portion 12. The rubber overmolding 14 may also include a pair of finger slider cut out portions 38 through which a user of the snorkel clip can see and touch the finger slider tabs 28 of the lower substantially rigid portion 12. Direct access to the thumb slider tab 26 and finger slider tabs 28 through the thumb slider cut out portion 36 and the finger slider cut out portions 38 can allow the user to more easily adjust the position of the snorkel clip along the riser tube 18 of the snorkel. The rubber overmolding 14 may also include a pair of finger opening cut out portions, which are not illustrated in FIGS. 2A through 2C, through which the user of the snorkel clip can see and touch the finger opening tabs 30 of the upper substantially rigid portion 10. Direct access to the finger opening tabs 30 through these finger opening cut out portions may allow the user to more easily pry the upper substantially rigid portion 10 away from the riser tube 18 of the snorkel. It will be understood, however, that the thumb slider cut out portion 36 and/or the finger slider cut out portions 38 may have other suitable shapes, sizes and configurations, and that these portions are not required.

The rubber overmolding 14 may include one or more pads or cushions. For instance, the rubber overmolding 14 may include friction pads 40 located on the inside of the upper attachment arms 16 or on the inside of the lower attachment arms 20 so as to be positioned in between the upper attachment arms 16 and the riser tube 18 of the snorkel or in between the lower attachment arms 20 and the riser tube 18 of the snorkel. These friction pads 40 may act to increase the friction at the points where the snorkel clip contacts the riser tube 18 of the snorkel so as to prevent the snorkel clip from accidentally slipping up or down the riser tube 18.

The rubber overmolding 14 may also include one or more cushioning pads 42 located at an area on the snorkel clip that the users face or temple is likely to contact. Because the cushioning pads 42 may be part of the rubber overmolding 14, the cushioning pads 42 may be generally soft and, therefore, cause the snorkel clip to be more comfortable for the user.

In addition, the rubber overmolding 14 may include one or more grip pads 44 located on the finger opening tabs 30 of the upper attachment arms 16. These grip pads 44 may include texturing such as ridges and allow the user to more easily grasp the finger opening tabs 30 of the upper attachment arms 16 in order to pry the upper substantially rigid portion 10 away from the riser tube 18 of the snorkel. It will be understood that the snorkel clip may include any suitable number and combination of pads and/or cushions. It will also be understood that the snorkel clip does not require any pads or cushions.

As shown in FIGS. 3A through 3D, the snorkel clip may be formed by overmolding a substantially flexible portion onto an upper substantially rigid portion and a lower substantially rigid portion. The substantially flexible portion or rubber overmolding preferably covers at least a portion of the upper substantially rigid portion and the lower substantially rigid portion. In addition, the snorkel clip preferably includes one or more cut out portions through which parts of the upper substantially rigid portion and/or parts of the lower substantially rigid portion can be seen or touched. Advantageously, the rubber overmolding may be a different color than the upper substantially rigid portion and the lower substantially rigid portion, which may allow an aesthetically pleasing design to be created.

As shown in FIGS. 3A through 3D, the thumb slider tab 26 and finger slider tabs 28 of the lower substantially rigid portion can be seen and touched through the thumb slider cut out portion 36 and the finger slider cut out portions 38. When the rubber overmolding 14 is a different color than the upper substantially rigid portion 10 and the lower substantially rigid portion 12, an aesthetically pleasing color contrast can be formed. Furthermore, if the rubber overmolding 14 is a different color than upper substantially rigid portion 10, a decorative design 46 such as a logo or a trademark can be easily seen through the decorative cut out portion 34 of the rubber overmolding 14. Significantly, this may provide a marking or identifying function in addition to increasing the aesthetic appeal of the snorkel clip.

As seen in FIG. 4A through 4C, the snorkel clip is preferably attached to the riser tube 18 of a snorkel. In particular, as shown in FIG. 4A, the upper attachment arms 16 and lower attachment arms 20 preferably wrap at least half way around the riser tube 18 in order to attach the snorkel clip to the riser tube 18. As shown in FIG. 4B, when the snorkel clip is attached to the riser tube 18 of a snorkel, a decorative design 46 may be visible. It will be understood, however, that a design 46 is not required.

Referring now to FIG. 4C, when the snorkel clip is attached to the riser tube 18 of a snorkel, a mask strap space 48 may be disposed between the riser tube 18 and the strap retaining portion 33 of the snorkel clip. The strap of the mask may be placed in this mask strap space 48 to secure a snorkel to the mask strap. The mask strap may be prevented from separating from the snorkel as it is held in place between the riser tube 18 and the strap retaining portion 33. Additionally, the mask strap may be prevented from sliding up or down along the riser portion 18 by the upper attachment arms 16 and the lower attachment arms 20.

Still referring to FIG. 4C, a mask strap may be placed within the mask strap space 48 by disengaging and pulling the upper engagement arms 16 away from the riser tube 18 of the snorkel. The snorkel clip may bend at the rubber hinge 32 to create a large, swing-open access to the strap space 48. The mask strap may then be placed inside the mask strap space 48. The mask strap may be secured to the snorkel by pressing the upper engagement arms 16 back into engagement with the riser tube 18 of the snorkel tube so that they wrap at least half way around the riser tube 18.

What is claimed is:

1. A snorkel clip comprising:

one or more substantially rigid portions constructed from a rigid material comprising plastic;

one or more substantially flexible portions connected to the one or more substantially rigid portions, the substantially flexible portions being overmolded onto the substantially rigid portions and creating a flexible hinge between the substantially rigid portions; and a strap retaining portion defined by the one or more substantially rigid portions and/or the one or more substantially flexible portions, wherein the strap retaining portion is configured, when the snorkel clip is attached to a snorkel, to retain a strap of a mask between the strap retaining portion and the snorkel such that the strap can make direct contact with the strap retaining portion or the snorkel;

wherein the strap retaining portion does not wrap at least half way around a riser tube of the snorkel; and wherein the strap of the mask may be held in place between the strap retaining portion and the riser tube of the snorkel when the snorkel clip is attached to the snorkel.

2. The snorkel clip as in claim 1, further comprising one or more contact pads to cushion the points where the snorkel clip is designed to contact either a riser tube of a snorkel or a user of the snorkel clip.

3. A snorkel clip comprising:

a first substantially rigid portion including two outwardly extending attachment arms that may be disposed about a significant portion of a riser tube of a snorkel but the arms do not completely enclose the riser tube of the snorkel when the snorkel clip is attached to a snorkel;

a second substantially rigid portion;

a substantially flexible portion at least partially disposed between and connected to the first substantially rigid portion and the second substantially rigid portion; and a strap retaining portion at least partially defined by the first substantially rigid portion, the second substantially rigid portion, and the substantially flexible portion;

wherein the strap retaining portion is configured, when the snorkel clip is attached to a snorkel, to retain a strap of a mask between the strap retaining portion and the snorkel such that the strap can make direct contact with the strap retaining portion or the snorkel; and wherein the strap retaining portion does not wrap at least half way around a riser tube of the snorkel; and wherein the strap of the mask may be held in place between the strap retaining portion and the riser tube of the snorkel when the snorkel clip is attached to the snorkel.

4. A clip for connecting a snorkel to the strap of a mask comprising:

an upper substantially rigid framework;

a lower substantially rigid framework;

a substantially flexible portion connected to the upper substantially rigid framework and to the lower substantially rigid framework;

a first upper attachment arm and a second upper attachment arm connected to or included as part of the upper substantially rigid framework wherein the first upper attachment arm and the second upper attachment arm are sized and configured to wrap at least half way around a riser tube of a snorkel;

a first lower attachment arm and a second lower attachment arm connected to or included as part of the lower substantially rigid framework wherein the first lower attachment arm and the second lower attachment arm are sized and configured to wrap at least half way around a riser tube of a snorkel; and a strap retaining portion positioned along the riser tube of the snorkel between the upper and lower attachment arms;

wherein the strap retaining portion does not wrap at least half way around a riser tube of the snorkel;

wherein the strap of the mask may be held in place between the strap retaining portion and the riser tube of the snorkel when the snorkel clip is attached to the snorkel;

wherein the upper substantially rigid framework and the lower substantially rigid framework are constructed from a rigid material comprising plastic;

wherein the substantially flexible portion is constructed from a flexible material comprising rubber; and wherein the substantially flexible portion is overmolded onto the upper substantially rigid framework and the lower substantially rigid framework.

5. The clip as in claim 4, wherein the strap retaining portion has sufficient structural support such that the clip can be moved up or down the riser tube of the snorkel by sliding the upper substantially rigid framework or the lower substantially rigid framework up or down the riser tube.

6. The clip as in claim 4, further comprising a substantially flexible hinge as part of the substantially flexible portion;

wherein the first lower attachment arm and the second lower attachment arm are designed to remain wrapped at least half way around the riser tube of the snorkel in a generally stationary position while the clip is connected to the snorkel;

wherein the first upper attachment arm and the second upper attachment arm are designed to wrap at least half way around the riser tube of the snorkel in a generally removable, snap fit configuration;

wherein the clip may bend at the substantially flexible hinge; and wherein the upper rigid framework may be disengaged and pulled away from the riser tube of the snorkel while the lower rigid framework remains generally attached to the riser tube of the snorkel.

7. The clip as in claim 4, further comprising a substantially flexible hinge as part of the substantially flexible portion wherein the clip may bend at the substantially flexible hinge thereby allowing the upper substantially rigid framework or the lower substantially rigid framework to extend away from a riser tube of a snorkel.

8. The clip as in claim 4, wherein the upper substantially rigid framework and the substantially flexible portion are not the same color;

wherein the lower substantially rigid framework and the substantially flexible portion are not the same color; and wherein the substantially flexible portion includes one or more cut out sections through which at least a part of the upper substantially rigid framework or at least a part of the lower substantially rigid framework is visible.

9. The clip as in claim 4, further comprising one or more contact pads to cushion the points where the clip is designed to contact either a riser tube of a snorkel or a user of the clip.

10. A snorkel clip that is capable of being used in connection with a snorkel, the snorkel clip comprising:

a first attachment portion that is sized and configured to be attached to the snorkel, the first attachment portion including at least one outwardly extending attachment arm, the first attachment portion including an at least substantially rigid portion;

a second attachment portion that is sized and configured to be attached to the snorkel, the second attachment portion including at least one outwardly extending attachment arm, the second attachment portion including an at least substantially rigid portion; and a strap retaining portion at least partially defined by the first attachment portion and/or the second attachment portion, wherein the strap retaining portion is sized and configured, when the snorkel clip is attached to a snorkel, to help maintain a strap of a mask in a desired position between the strap retaining portion and the snorkel such that the strap can make direct contact with the strap retaining portion or the snorkel;

wherein the strap retaining portion does not wrap at least half way around a riser tube of the snorkel;

wherein the strap of the mask may be held in place between the strap retaining portion and the riser tube of the snorkel when the snorkel clip is attached to the snorkel;

wherein the first attachment portion is disposed about at least a first portion of the snorkel but does not completely enclose the first portion of the snorkel; and wherein the second attachment portion is disposed about at least a second portion of the snorkel but does not completely enclose the second portion of the snorkel.

11. The snorkel clip as in claim 10, wherein the strap retaining portion is at least partially disposed between the attachment arm of the first attachment portion and the attachment arm of the second attachment portion.

12. The snorkel clip as in claim 10, further comprising a connecting portion at least partially disposed between the first attachment portion and the second attachment portion in order to allow the first attachment portion or the second attachment portion to extend away from a riser tube of the snorkel.

13. The snorkel clip as in claim 10, wherein the first attachment portion includes two outwardly extending attachment arms that are sized and configured to wrap at least half way around a riser tube of the snorkel; and wherein the second attachment portion includes two outwardly extending attachment arms that are sized and configured to wrap at least half way around a riser tube of the snorkel.

14. The snorkel clip as in claim 10, wherein the first attachment portion is sized and configured to be attached to the riser tube of the snorkel in a snap fit configuration.

15. The snorkel clip as in claim 10, further comprising one or more contact pads that are sized and configured to cushion the points where the snorkel clip is designed to contact either the snorkel or a user of the snorkel.

16. The snorkel clip as in claim 10, wherein an at least partially flexible portion is at least partially disposed between the first attachment portion and the second attachment portion.

17. The snorkel clip as in claim 10, further comprising one or more cut out sections in the first attachment portion that are sized and configured to allow at least a portion of the substantially rigid portion of the first attachment portion to be exposed.

18. A snorkel clip that is capable of being attached to a snorkel, the snorkel clip comprising:

a first attachment portion that is sized and configured to be attached to the snorkel, the first attachment portion comprising:

a generally rigid body; and one or more outwardly extending attachment arms that are sized and configured to be disposed about at least a portion of the snorkel; and a second attachment portion that is sized and configured to be attached to the snorkel, the second attachment portion comprising:

a generally rigid body; and one or more outwardly extending attachment arms that are sized and configured to be disposed about at least a portion of the snorkel; and a strap retaining portion at least partially defined by the first attachment portion and/or the second attachment portion, wherein the strap retaining portion is configured, when the snorkel clip is attached to the snorkel, to retain a strap of a mask between the strap retaining portion and the snorkel such that the strap can make direct contact with the strap retaining portion or the snorkel;

wherein the strap retaining portion does not wrap at least half way around a riser tube of the snorkel;

wherein the strap of the mask may be held in place between the strap retaining portion and the riser tube of the snorkel when the snorkel clip is attached to the snorkel; and wherein at least a portion of the strap retaining portion is flexible to allow the first attachment portion or the second attachment portion to be selectively detached from and extend away from the snorkel while at least a portion of the snorkel clip is still attached to the snorkel.

19. The snorkel clip as in claim 18, wherein the strap retaining portion is at least partially disposed between the outwardly extending arms of the first attachment portion and the outwardly extending arms of the second attachment portion.

20. The snorkel clip as in claim 18, wherein the first attachment portion is sized and configured to engage a riser tube of the snorkel in a snap fit configuration; and wherein the second attachment portion is sized and configured to engage the riser tube of the snorkel in a snap fit configuration.

21. The snorkel clip as in claim 18, wherein the first attachment portion includes two outwardly extending attachment arms that that may be disposed about a significant portion of the riser tube of the snorkel but the arms do not completely enclose the riser tube of the snorkel.

22. The snorkel clip as in claim 18, wherein the first attachment portion includes two arms that encircle at least a portion of the snorkel; and wherein the second attachment portion includes two arms that that encircle at least a portion of the snorkel.

23. The snorkel clip as in claim 18, wherein at least a portion of the body of the first attachment portion is spaced apart from the snorkel; and wherein at least a portion of the body of the second attachment portion is spaced apart from the snorkel.

24. The snorkel clip as in claim 18, further comprising a connector connecting the first attachment portion and the second attachment portion.

25. The snorkel clip as in claim 18, further comprising a connecting portion connecting the first attachment portion and the second attachment portion, the connecting portion covering at least a portion of the first attachment portion and at least a portion of the second attachment portion.

26. The snorkel clip as in claim 18, wherein an at least partially flexible portion is at least partially disposed between the first attachment portion and the second attachment portion.

27. The snorkel clip as in claim 18, further comprising one or more cut out sections in the first attachment portion that are sized and configured to allow at least a portion of the generally rigid body of the first attachment portion to be exposed.

28. A snorkel clip that is sized and configured to be used in connection with a snorkel, the snorkel clip comprising:

a body including a first end, a second end and a connecting portion at least partially disposed between the first end and the second end, at least a portion of the connecting portion being spaced apart from the snorkel when the clip is attached to the snorkel;

a first outwardly extending extension arm and a second outwardly extending extension arm disposed at least proximate the first end of the body, the first and second outwardly extending extension arms being sized and configured to allow the clip to be attached to the snorkel; and a strap retaining portion at least partially defined by the first end of the body, the second end of the body and the connecting portion of the body, the strap retaining portion being sized and configured, when the snorkel clip is attached to a snorkel, to help maintain a strap of a mask in a desired position between the strap retaining portion and the snorkel such that the strap can make direct contact with the strap retaining portion or the snorkel;

wherein the strap retaining portion does not wrap at least half way around a riser tube of the snorkel;

wherein the strap of the mask may be held in place between the strap retaining portion and the riser tube of the snorkel when the snorkel clip is attached to the snorkel; and wherein the strap retaining portion is at least partially defined by the first outwardly extending extension arm of the first end of the body, the second outwardly extending extension arm of the first end of the body, the second end of the body and the connecting portion of the body.

29. The snorkel clip as in claim 28, further comprising a first outwardly extending extension arm and a second outwardly extending extension arm disposed at least proximate the second end of the body.

30. The snorkel clip as in claim 28, wherein at least a portion of the first end of the body is sized and configured to contact a portion of the snorkel when the clip is attached to the snorkel;

wherein at least a portion of the second end of the body is sized and configured to contact a portion of the snorkel when the clip is attached to the snorkel; and wherein at least a portion of the connecting portion of the body is sized and configured to be spaced apart from the snorkel when the clip is attached to the snorkel.

31. The snorkel clip as in claim 28, wherein the first and second outwardly extending extension arms are sized and configured to wrap at least half way around a riser tube of the snorkel; and wherein the connecting portion does not wrap at least half way around the riser tube of the snorkel.

32. The snorkel clip as in claim 28, further comprising a mask strap space that is disposed between a riser tube of the snorkel and the connecting portion of the body when the clip is attached to the snorkel, the mask strap space being at least partially defined by the first and second outwardly extending extension arms of the first end of the body, the connecting portion of the body, the second end of the body and a portion of the riser tube of the snorkel.

* * * * *